US006485172B1

(12) United States Patent
Takahashi et al.

(10) Patent No.: US 6,485,172 B1
(45) Date of Patent: Nov. 26, 2002

(54) SELF-WINDING WATCH

(75) Inventors: Masaaki Takahashi, Chiba (JP); Takeshi Tokoro, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/581,385

(22) PCT Filed: Dec. 18, 1998

(86) PCT No.: PCT/JP98/05729

§ 371 (c)(1),
(2), (4) Date: Aug. 29, 2000

(87) PCT Pub. No.: WO99/31558

PCT Pub. Date: Jun. 24, 1999

(30) Foreign Application Priority Data

Dec. 18, 1997 (JP) ..... 9-349108

(51) Int. Cl.[7] ..... G04B 5/00; G04B 7/00
(52) U.S. Cl. ..... 368/148; 368/208
(58) Field of Search ..... 368/148, 149, 368/207, 208, 150, 151

(56) References Cited

U.S. PATENT DOCUMENTS 3,306,025 A * 2/1967 Kocher ..... 368/148
3,628,325 A * 12/1971 Morita ..... 368/148
3,901,021 A * 8/1975 Tutiya ..... 368/208
3,999,371 A * 12/1976 Zaugg et al. ..... 368/208
4,174,607 A * 11/1979 Wuthrich ..... 368/148
4,363,553 A * 12/1982 Thomi et al. ..... 368/148
4,500,213 A * 2/1985 Grimm ..... 368/208
5,867,454 A * 2/1999 Takahashi et al. ..... 368/148
6,422,348 B1 * 7/2002 Jujo et al. ..... 368/148

* cited by examiner

*Primary Examiner*—Vit Miska
*Assistant Examiner*—Jeanne-Marguerite Goodwin
(74) *Attorney, Agent, or Firm*—Adams & Wilks

(57) ABSTRACT

A movement 100 of a self-winding watch has a main plate 102, a train wheel bridge 104, a center wheel bridge 106, a third wheel bridge 107 and a transmission bridge 108. An oscillating weight 160 is rotatably attached to a third bridge 107. A first transmission intermediate gear 178*a* is structured to mesh with a first transmission gear 180*a* and oscillation weight pinion 176. An eccentric shaft-part 180*d* is provided on the first transmission wheel 180. A pawl lever 182 is assembled between the third wheel bridge 107 and the center wheel bridge 106. The pawl lever 182 has a guide hole 182*a* rotatably assembled on the eccentric shaft part 180*d*. The eccentric motion of pawl lever 182 winds up a spiral spring.

17 Claims, 5 Drawing Sheets

SELF-WINDING WATCH

BACKGROUND OF THE INVENTION

1. Field of the Invention

The present invention relates to a self-winding watch structured to wind up a spiral spring in a barrel complete due to rotation of an oscillating weight and, more particularly, to a self-winding watch having a self-winding mechanism constituted by components including a pawl lever arranged on a main plate side of a bridge member thereof.

2. Background Information

Referring to FIG. 5, in a conventional self-winding watch a movement 500 of the self-winding watch is provided with a main plate 102, a train wheel bridge 104 and a center wheel bridge 106.

The "movement" herein refers to a watch mechanical part, and a "glass side" signifies a side on which a glass 110 is present when a movement is assembled in a case. Meanwhile, a "back lid side" shows a side where a back lid 112 exists when a movement is assembled in a case. Accordingly, the train wheel bridge 104 and the center wheel bridge 106 are assembled on a back lid side of the main plate 102.

A date indicator maintaining plate 116 is assembled on a glass side of the main plate 102. A dial 118 is assembled on a glass side of the date indicator maintaining plate 116.

A barrel complete 120, a minute wheel 122, a second wheel 124 and a hour wheel 126 are rotatably assembled in the movement 500. A glass 110 protects the movement 500.

A ratchet wheel 150 is assembled on a back lid side of the train wheel bridge 104. The ratchet wheel 150 has a square hole 150*a* assembled on a corner part 120*b* of a barrel complete stem 120*a* of a barrel complete 120. A ratchet wheel screw 152 fixes the ratchet wheel 150 on the barrel complete stem 120*a*.

An-oscillating weight 160 includes a ball bearing part 162, an oscillating weight body 164 and a weight 166. The ball bearing part 162 includes an inner ring 168, a ball stopper ring 170 and an outer ring 172 to assemble a plurality of balls 174 in between the inner ring 168, the ball stopper ring 170 and the outer ring 172. An oscillation weight pinion 176 is provided on an outer periphery of the outer ring 172.

A first transmission wheel 180 is rotatably assembled on the train wheel bridge 104 and main plate 102. The first transmission wheel 180 has a first transmission gear 180*a*, an upper guide shaft part 180*b* and a lower guide shaft part 180*c*. The first transmission gear 180*a* is structured to mesh with the oscillating weight pinion 176 through a first transmission intermediate wheel 178. An eccentric shaft part 180*d* is provided between the first transmission gear 180*a* and the upper guide shaft part 180*b* on the first transmission wheel 180. The upper guide shaft part 180*b* is rotatably supported on the train wheel bridge 104. The lower guide shaft part 180*c* is rotatably supported on the main plate 102.

A pawl lever 182 is assembled in between the first transmission gear 180*a* and the train wheel bridge 104. Consequently, the pawl lever 182 is arranged on a back lid side of the train wheel bridge 104 as a bridge member. The pawl lever 182 has a push pawl (not shown) and a draw pawl 182*c*. The pawl lever 182 at its guide hole 182*a* is rotatably assembled over the eccentric shaft part 180*d* of the first transmission wheel 180. A transmission holder 183 is attached to the first transmission wheel 180 in a closer position than the eccentric shaft part 180*d* to the lower guide shaft part 180*c*.

A second reduction wheel 184 is assembled on a back lid side of the train wheel bridge 104 and rotatably attached by a second reduction screw 185. The second reduction wheel 184 has a second reduction gear 184*a* and a second reduction pinion 184*b*. The second reduction gear 184*a* is structured in a ratchet gear form. The push pawl and draw pawl 182*c* of the pawl lever 182 engage this ratchet gear 184*a*. The second reduction pinion 184*b* is in mesh with the ratchet wheel 150.

When the oscillating weight 160 rotates, the rotation of oscillating weight pinion 176 causes rotation in the first transmission wheel 180. The pawl lever 182 is reciprocally moved based on eccentric motion of the eccentric shaft part 180*d* by the rotation of first transmission wheel 180, causing the second reduction wheel 184 to rotate in a given direction through the push pawl and draw pawl 182*c*. The rotation of second reduction wheel 184 rotates the ratchet wheel 150, thus winding up the spiral spring 120*c* in the barrel complete 120.

However, the conventional self-winding watch using a pawl lever has the following problems.

(1) Because the pawl lever is arranged between the bridge member supporting oscillating weight and the oscillating weight body, a space is required to arrange a lever on a back lid side of this bridge member. This accordingly increases an outer dimension of the watch movement (mechanical assembly) and also a thickness of the movement.

(2) Because the pawl lever can be seen directly at the back lid, the oil supplied to a rotational part of the pawl lever and to the pawl is seen at the back lid. It is accordingly difficult to improve appearance on the movement of a watch made with a back-lid skeleton.

(3) Because the pawl lever is arranged between the closest bridge member to the back lid and the oscillating weight body, the structure supporting the pawl lever is complicated.

Therefore, it is an object of the present invention to provide, in order to solve the foregoing problems in the conventional art, a self-winding watch having a reduced size and thickness by arranging a pawl lever on a main plate side of a bridge member.

Another object of the invention is to provide a self-winding watch which has a good aesthetic appearance from a back lid side of a movement.

Furthermore, another object of the invention is to provide a self-winding watch which can support a pawl lever by a simple structure.

SUMMARY OF THE INVENTION

In order to-solve the above problem, the present invention is structured such that, in a self-winding watch structure to wind up a spiral spring in a barrel complete through a self-winding mechanism due to rotation of an oscillating weight, the self-winding watch comprises: a main plate structuring a base plate of a self-winding watch; a bridge member rotatably supporting at least one shaft part of a wheel train constituting the self-winding mechanism; at least one first transmission wheel to be rotated by rotation of the oscillating weight; a pawl lever to be elastically moved by rotation of the first transmission wheel; a second reduction wheel to be rotated by eccentric motion of the pawl lever; and a barrel complete including a spiral spring to be wound up by rotation of the second reduction wheel; wherein the lever at least one part thereof is arranged on a side of the main plate with respect to the bridge member. This bridge member is structured, for example, by a third wheel bridge rotatably supporting a third wheel. This bridge member may be a part constituting a self-winding wheel train, a transmission wheel bridge rotatably supporting the oscillating weight or a train wheel bridge rotatably supporting a wheel train including the barrel complete. It is preferred that the first transmission wheel is structured by a first transmission wheel and the second reduction wheel is by a second reduction wheel.

Meanwhile, in the self-winding watch of the invention, the bridge member is preferably structured to rotatably receive at least one of a wheel train, constituting a self-winding mechanism.

This structure can reduce the size and thickness of self-winding mechanism and support the pawl lever by a simple structure.

Furthermore, the present invention is structured such that, in a self-winding watch structure to wind up a spiral spring in a barrel complete due to rotation of an oscillating weight, a main plate and at least one bridge member are provided. The oscillation weight is rotatably supported by the bridge member. This self-winding watch has a first transmission intermediate wheel to be rotated by rotation of the oscillating weight and a first transmission wheel structured to be rotated by rotation of the first transmission intermediate wheel. This first transmission wheel has an eccentric shaft part provided in a closer position to the main plate than the bridge member. A pawl lever is structured to eccentrically move due to rotation of the eccentric shaft part of the first transmission wheel. The pawl lever has at least one part arranged on a side of the main plate with respect to the bridge member. A second reduction wheel has a ratchet gear to be rotated in one direction by a feed pawl of the pawl lever.

The self-winding watch of the invention has a ratchet wheel to be rotated in one direction by rotation of the second reduction wheel, and a barrel complete accommodating a spiral spring to be wound up by rotation of the ratchet wheel.

In the self-winding watch of the invention, the first transmission intermediate wheel at its gear part and the first transmission wheel at its gear part may be structured arranged between the oscillation weight and the bridge member.

This structure improves appearance of the movement on its back lid side.

Also, in the self-winding watch of the invention, the gear part of the-first transmission intermediate wheel may have at least one part arranged on the main plate side of the bridge member. Furthermore, the gear part of the first transmission wheel may have at least one part arranged on the main plate side of the bridge member.

This structure can rotatably support the first transmission intermediate wheel and the first transmission wheel with positiveness.

DETAILED DESCRIPTION OF THE PREFERRED EMBODIMENTS

Hereunder, a mode for carrying out the invention will be explained based on the drawings.

(1) Structure of a First Embodiment of a Self-winding Watch of the Invention

Hereunder, a structure of a first embodiment of a self-winding watch of the invention will explained.

Figure 1:
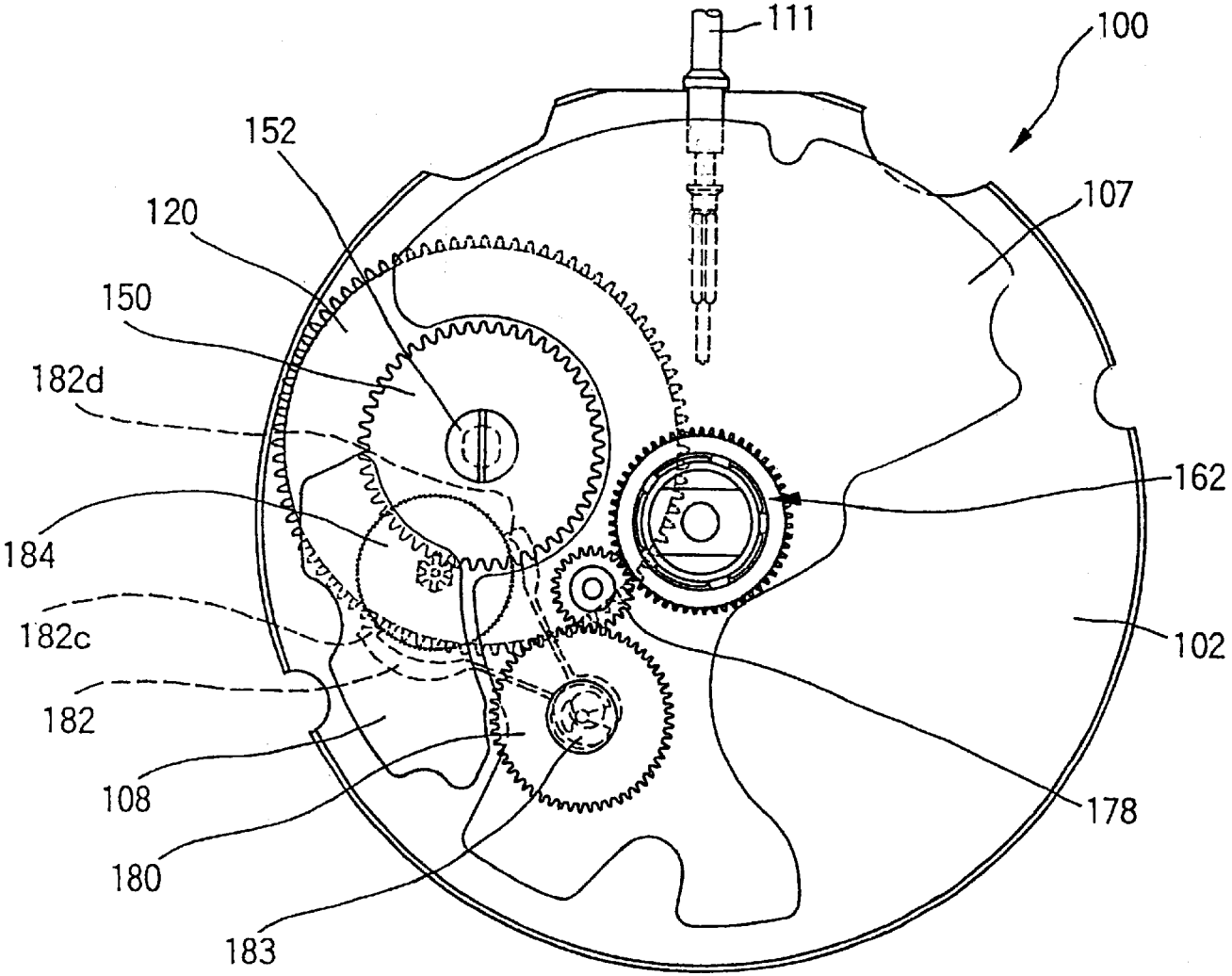
FIG. 1 is a schematic plan view of a movement, as viewed from a back lid side, of a first embodiment of a self-winding watch of the invention.
Figure 2:
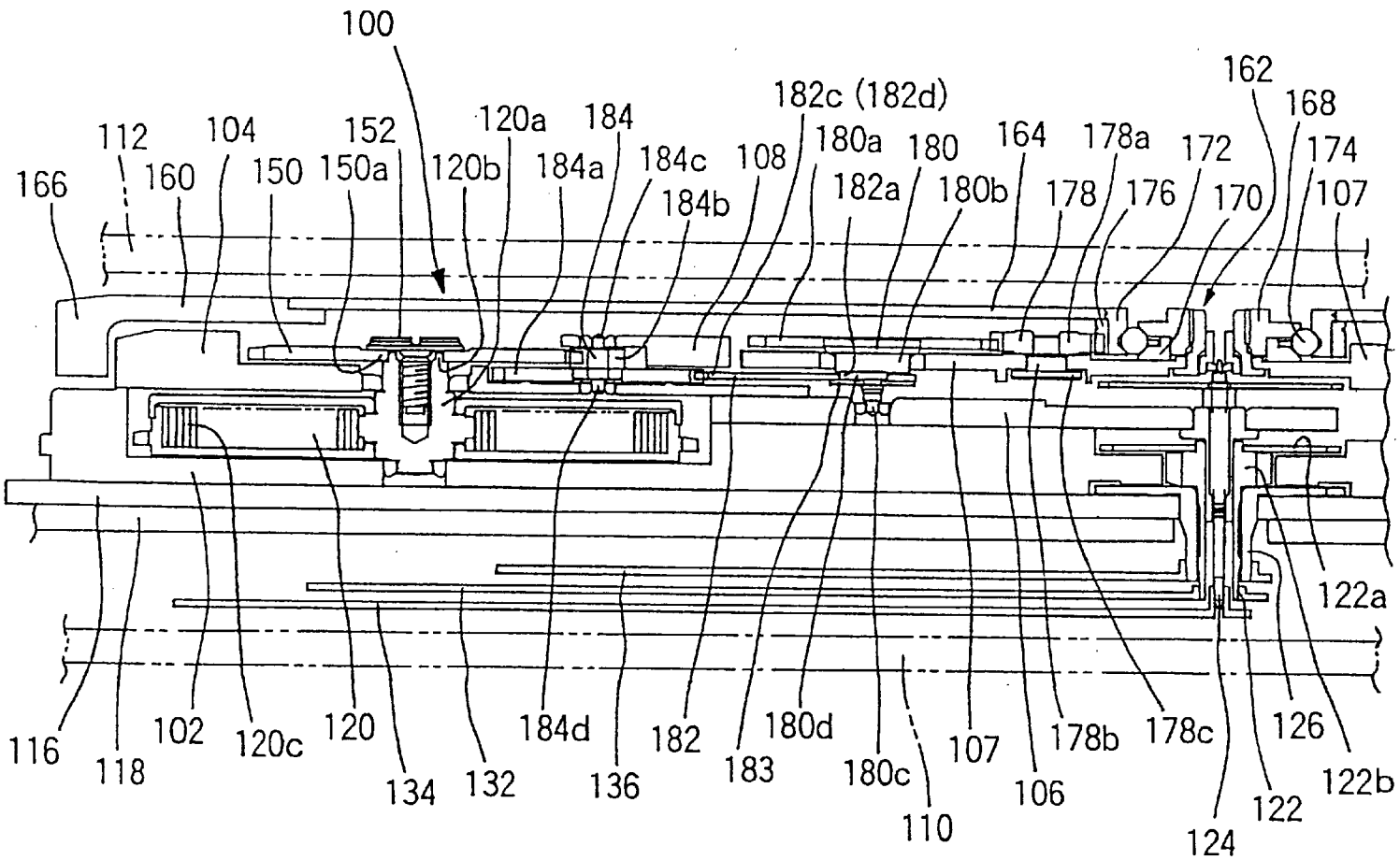
FIG. 2 is a partial sectional view of a self-winding mechanism of the movement of the first embodiment of the self-winding watch of the invention.

Referring to FIG. 1 and FIG. 2, in a self-winding watch of the invention, a movement 100 of the self-winding watch is provided with a main plate 102, a train wheel bridge 104, a center wheel bridge 106, a third wheel bridge 107 and a transmission bridge 108. The train wheel bridge 104, center wheel bridge 106, third wheel bridge 107 and transmission bridge 108 are assembled on a side of a back lid of the main plate 102. The third wheel bridge 107 is assembled on the side of the back lid of the center wheel bridge 106. The third wheel bridge 107 rotatably supports an upper shaft part of a third wheel (not shown). A hand setting stem 111 is assembled in the main plate 102.

A date indicator maintaining plate 116 is assembled on a glass side of the main plate 102. A dial 118 is assembled on the glass side of the date indicator maintaining plate 116.

A barrel complete 120 is rotatably assembled between the train wheel bridge 104 and the main plate 102. Although the train wheel bridge 104 rotatably supports the upper shaft part of the barrel complete 120, it may be structured to rotatably support other wheel train. The train wheel bridge 104 may be a barrel complete retainer to rotatably support only the upper shaft part of the barrel complete 120.

A minute wheel 122 is rotatably assembled between the center wheel bridge 106 and the main plate 102. The minute wheel 122 is structured to rotate once per hour due to rotation of the barrel complete 120. The minute wheel 122 is provided with a minute gear 122*a* and a minute pinion 122*b*, and the minute gear 122*a* is structured to slip over the minute pinion 122*b*. The minute wheel 122 may be a center wheel. In a structure using a center wheel, a hour pinion is structurally used which is assembled to slip over a cylinder outer periphery of the center wheel.

A second wheel 124 are assembled between the third wheel bridge 107 and the center wheel bridge 106. The second wheel 124 is structurally rotates-once per minute through rotation of a third wheel (not shown) due to the minute wheel 122. An hour wheel 126 is rotatable assembled between the main plate 102 and the date indicator maintaining plate 116. The hour wheel 126 is structurally rotates once per 12 hours through date back wheel (not shown) due to the rotation of the minute wheel 122.

A minute hand 132 is mounted on the minute wheel 122. A second hand 134 is mounted on the second wheel 124. The An hour hand 136 is mounted on the hour wheel 126. A glass 110 protects the movement 100.

A ratchet wheel 150 is assembled on a back lid side of the train wheel bridge 104. The ratchet wheel 150 at its square hole 150*a* is assembled on a corner part 120*b* of a barrel complete stem 120*a* of the barrel complete 120. A ratchet wheel screw 152 fixes the ratchet wheel 150 on the barrel complete stem 120*a*. A spiral spring 120*c* is accommodated in the barrel complete 120.

An oscillating weight 160 includes a ball bearing part 162, bearing part 162 includes an inner ring 168, a ball stopper ring 170 and an outer ring 172, and a plurality of balls 174 are assembled-between the inner ring 168, ball stopper ring 170 and the outer ring 172. An oscillating weight pinion 176 is provided at an outer periphery of the outer ring 172. The inner ring 168 and the ball stopper ring 170 are fixed to the third wheel bridge 107. The plurality of balls 174 allows the outer ring 172 to smoothly rotate relative to the inner ring 168 and ball stopper ring 170. The oscillating weight body 164 is fixed to the outer ring 172. The weight 166 is fixed to the oscillating weight body 164. Accordingly, the weight 166, the oscillating weight body 164, outer ring 172 and oscillating weight pinion 176 can rotate in one body together.

A first transmission intermediate wheel 178 is rotatably mounted on the third wheel bridge 107. The first transmission intermediate wheel 178 has a first transmission intermediate gear 178*a*, a guide shaft part 178*b* and a flange part 178*c*. The first transmission intermediate gear 178*a* is arranged on a back lid side of the third wheel bridge 107, and the flange part 178*c* is arranged on a glass side of the third wheel bridge 107.

A first transmission wheel 180 is rotatably assembled between the third wheel bridge 107 and the center wheel bridge 106. The first transmission wheel 180 has a first transmission gear 180*a*, an upper guide shaft part 180*b* and a lower guide shaft part 180*c*. The first transmission intermediate gear 178*a* is structured to mesh with the first transmission gear 180*a* and oscillating weight pinion 176. An eccentric shaft part 180*d* is provided on the first transmission wheel 180 between the upper guide shaft part 180*b* and the lower guide shaft part 180*c*. The eccentric shaft part 180*d* is structured to have a center axis eccentric from a center axis of the first transmission gear 180*a*. The upper guide shaft part 180*b* is rotatably supported with respect to the third wheel bridge 107. The lower guide shaft part 180*c* is rotatably supported with respect to the center wheel bridge 106.

A pawl lever 182 is assembled between the upper guide shaft part 180*b* and the center wheel bridge 106. That is, the pawl lever 182 in one part is assembled between the third wheel bridge and the center wheel bridge 106. Accordingly, the pawl lever 182 in one part is assembled on a main plate 102 side of the third wheel bridge 107. In this structure, the third wheel bridge 107 at a center part of the movement is a sustaining member arranged closest to the back lid 112.

The pawl lever 182 has a drawing pawl 182*c* and a push pawl 182*d*. The pawl lever 182 has a guide hole 182*a* rotatably assembled on the eccentric shaft part 180*d*. A transmission holder 183 is attached in a closer position to the lower guide shaft part 180*c* than the eccentric shaft part 180*d* of the first transmission wheel 180. The pawl lever 182 at its at its drawing, pawl 182*c* and the vicinity thereof is arranged on a main plate 102 side of the transmission bridge 108.

A second transmission wheel, or second reduction wheel, 184 is rotatably supported relative to the transmission bridge 108 and the train wheel bridge 104. The second reduction wheel 184 has a second reduction gear 184*a*, a second reduction pinion 184*b*, am upper guide shaft part 184*c* and a lower guide shaft part 184*d*. The second reduction gear 184*a* is structured in a form of a ratchet gear. The upper guide shaft part 184*c* is rotatably supported on the transmission wheel bridge 108. The lower guide shaft part 184*d* is rotatably supported on the train wheel bridge 104. The second reduction gear 184*a* in one part is arranged on a main plate 102 side of the transmission bridge 108 and the other one part on a main plate 102 side of the third wheel bridge 107.

The draw pawl 182*c* and push pawl 182*d* of the pawl lever 182 engage this ratchet gear 184*a*. The second reduction pinion 184*b* meshes with a ratchet wheel 150. The draw pawl 182*c* and the push pawl 182*d* are structurally urged toward a center of the ratchet gear by an elastic force, and the draw pawl 182*c* and the push pawl 182*d* are prevented from leaving from the ratchet gear 184*a*.

When the oscillating weight 160 rotates, the rotation of oscillating weight pinion 176 causes the first transmission intermediate wheel 178 to rotate. By the rotation of first transmission intermediate wheel 178, the first transmission wheel 180 is rotated. The pawl lever 182 performs reciprocal motion based on eccentric motion of the eccentric shaft part 180*d* due to the rotation of first transmission wheel 180, causing the second reduction wheel 184 to rotate in one direction through the draw pawl 182*c* and push pawl 182*d*. The rotation of second reduction wheel 184 rotates the ratchet wheel 150, winding up a spiral spring 120*c* in the barrel complete 120.

(2) Structure of a Second Embodiment of a Self-winding Watch of the Invention

Next, explanations will be made on a second embodiment of a self-winding watch of the invention. The below explanation is mainly on difference points between the second embodiment of the self-winding watch of the invention and the first embodiment.

Figure 3:
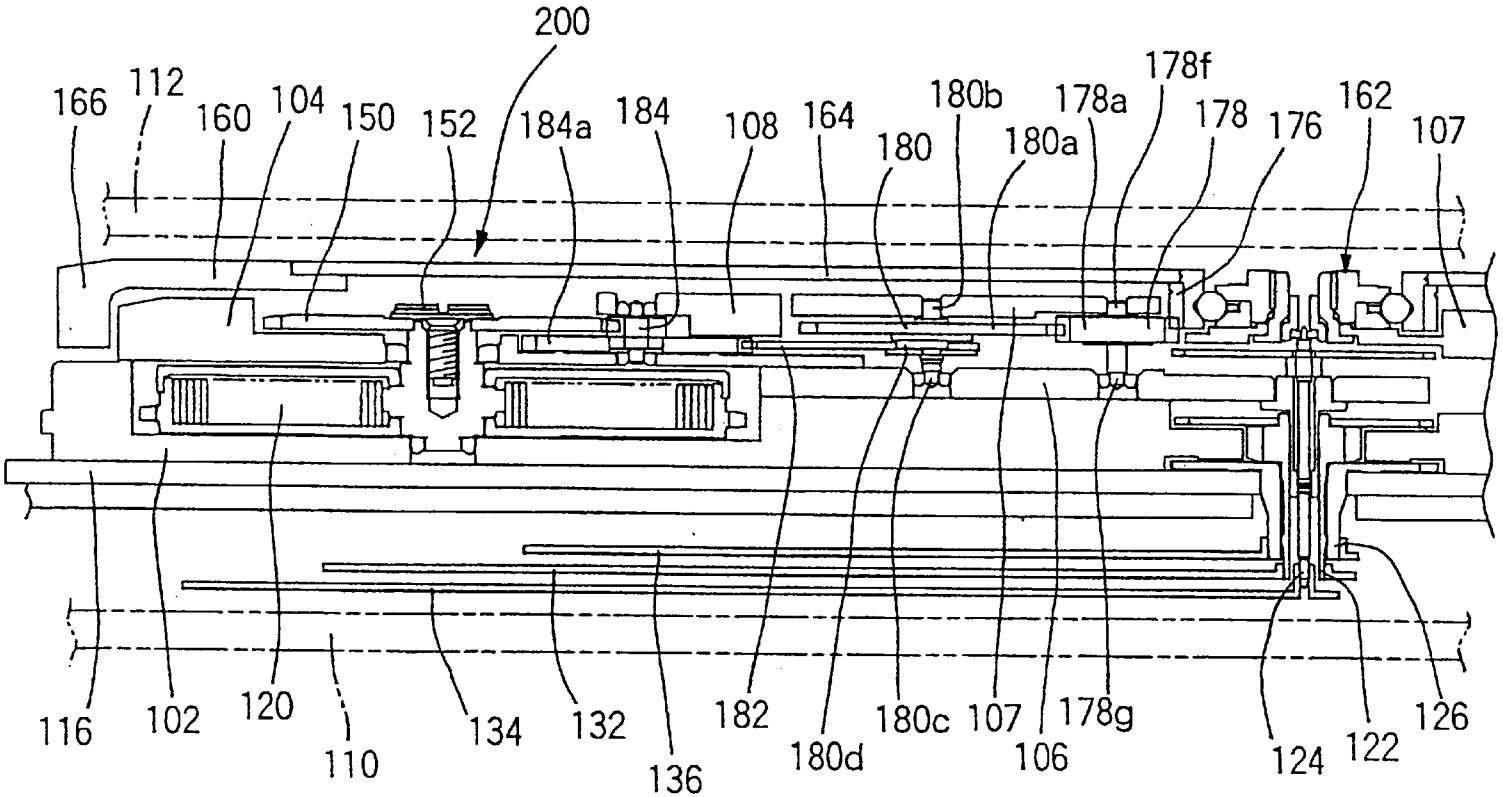
FIG. 3 is a partial sectional view of a self-winding mechanism of a movement of a second embodiment of a self-winding watch of the invention.

Referring to FIG. 3, in a movement 200 of the second embodiment of the self-winding watch of the invention, a first transmission intermediate wheel 178 is assembled between a third wheel bridge 107 and a center wheel bridge 106. The first transmission intermediate wheel 178 has a first transmission intermediate gear 178*a*, an upper guide shaft part 178*f* and a lower, guide shaft part 178*g*. The first transmission intermediate gear 178*a* is arranged between the third wheel bridge 107 and the center wheel bridge 106. The upper guide shaft part 178*f* is rotatably assembled on the third wheel bridge 107, and the lower guide shaft part 178*g* is rotatably assembled on the center wheel bridge 106.

A first transmission wheel 180 is rotatably supported on the third wheel bridge 107 and center wheel bridge 106. The first transmission wheel 180 has a first transmission gear 180*a*, an upper guide shaft part 180*b* and a lower guide shaft part 180*c*. The first transmission intermediate gear 178*a* is structured to mesh with the first transmission gear 180*a* and oscillating weight pinion 176. An eccentric shaft part 180*d* is provided on the first transmission wheel 180 at between the first transmission gear 180*a* and the lower guide shaft part 180*c*. The upper guide shaft part 180*b* is rotatably supported on the third wheel bridge 107. The lower guide shaft part 180*c* is rotatably supported on the center wheel bridge 106.

In this structure, the first transmission intermediate gear 178*a* and the first transmission gear 180*a* are arranged on a glass side of the third wheel bridge 107. A pawl lever 182 in one part is arranged on the glass side of the third wheel bridge 107 and in other portion on the glass side of the transmission bridge 108. A second reduction gear 184*a* in one part is arranged on the glass side of the transmission bridge 108 and the other part on the glass side of the third wheel bridge 107.

Therefore, it is possible to positively maintain all the wheel trains structuring the self-winding mechanism and preferably maintain a mesh state of the gears forming the wheel trains.

(3) Operation of the Self-winding Watch of the Invention

Next, the operation of the self-winding watch of the invention will be explained.

Figure 4:
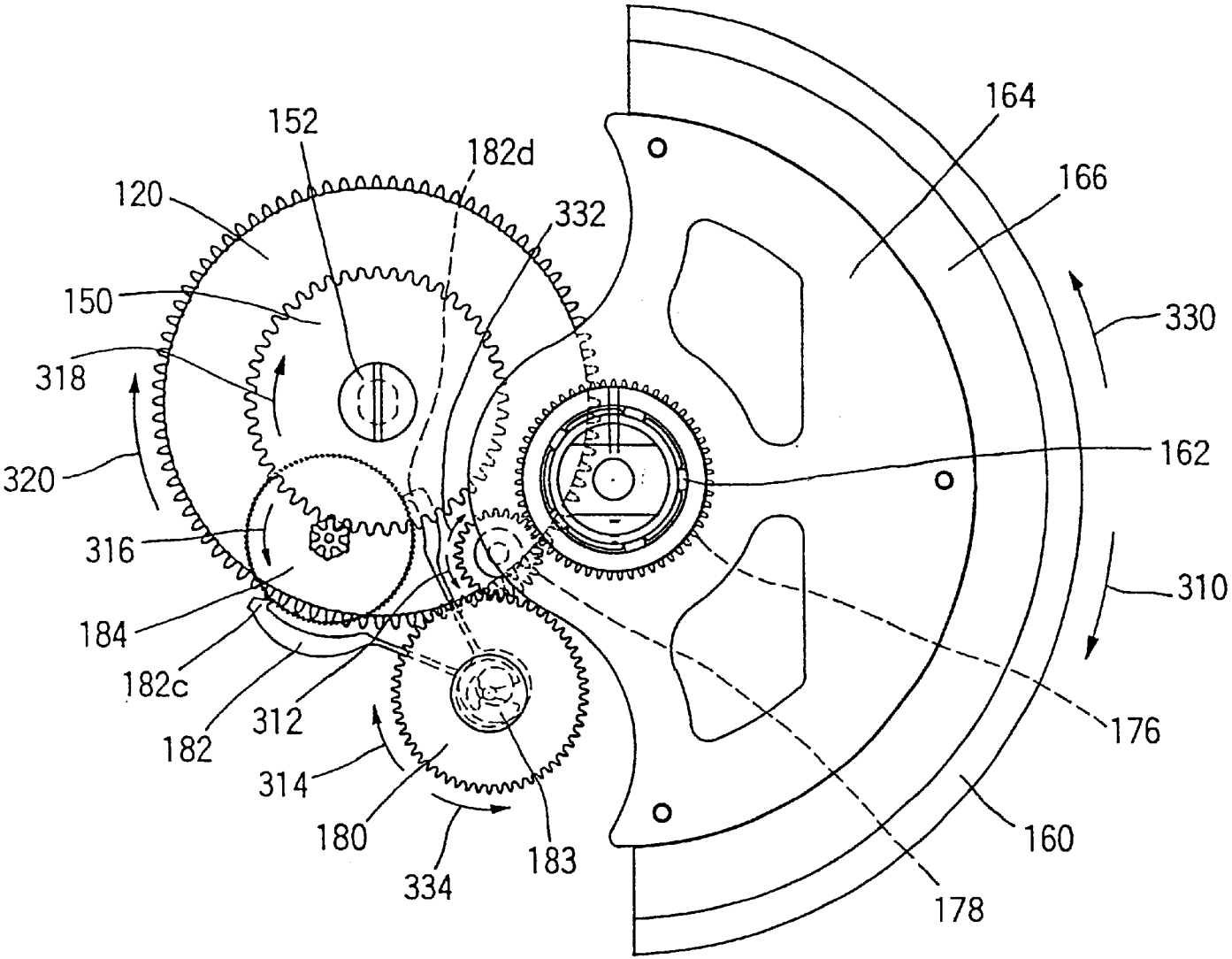
FIG. 4 is a broken-open view showing operation of the self-winding mechanism of the self-winding watch of the invention.
Figure 5:
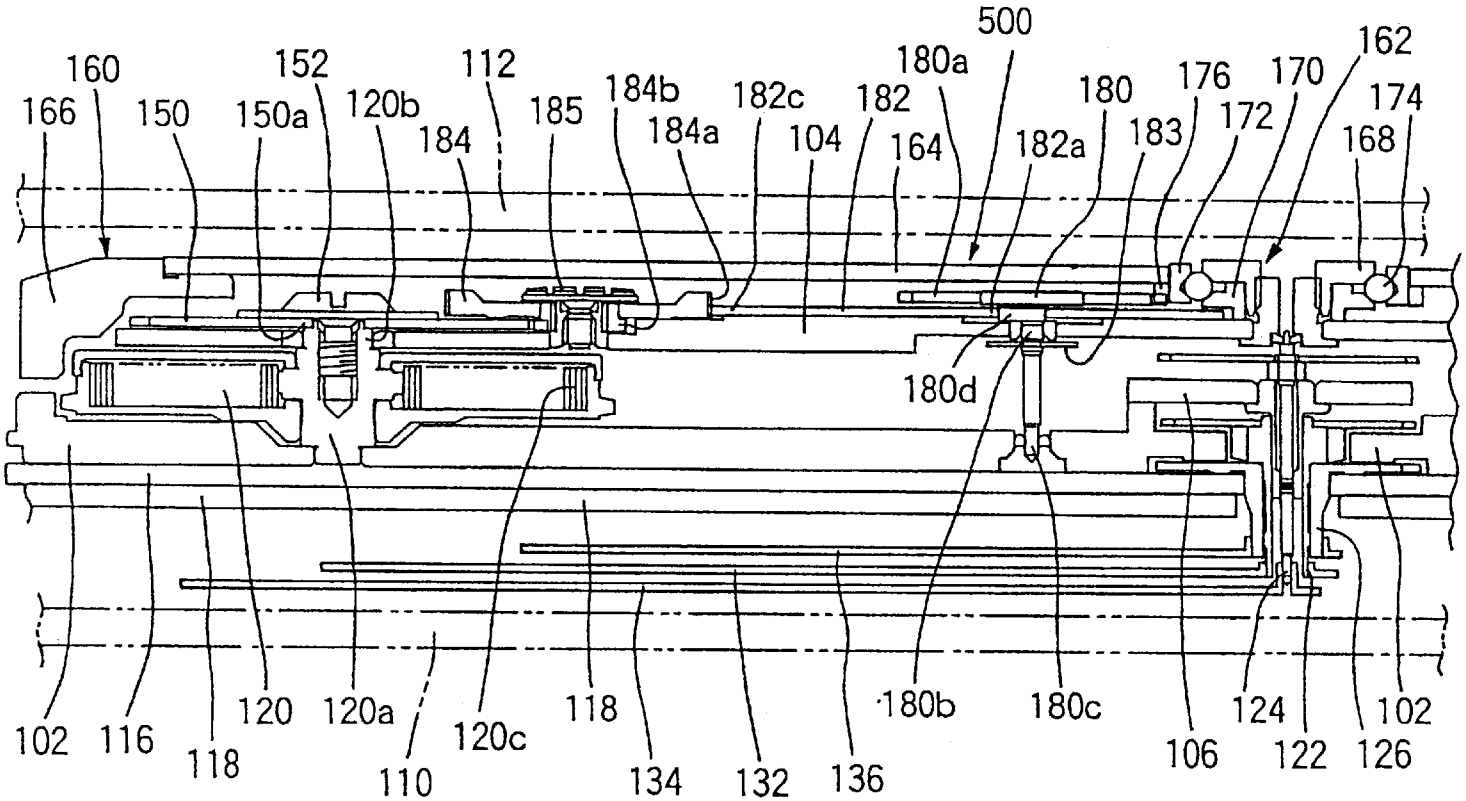
FIG. 5 PRIOR ART
FIG. 5 is a partial sectional view of a self-winding mechanism of a conventional self-winding watch.

Referring to FIG. 4, when th e oscillating weight 160 rotates in an arrow 310 direction (clockwise in FIG. 4), the first transmission intermediate wheel 178 is rotated in an arrow 312 direction (counterclockwise it FIG. 4) by rotation of the oscillating weight pinion 176. The rotation of first transmission intermediate wheel 178 rotates the first transmission wheel 180 in an arrow 314 direction (clockwise in FIG. 4).

The pawl lever 182 causes the eccentric shaft part 180*d* eccentrically move due to the rotation of the first transmission wheel 180. The eccentric motion of pawl lever 182 causes the draw pawl 182*c* and push pawl 182*d* to reciprocally move along an outer periphery of the second reduction wheel 184. As a result, due to the reciprocal motion of the draw pawl 182*c* and push pawl 182*d*, the second reduction wheel 184 rotates in a given direction, i.e. in an arrow 316 direction (counterclockwise in FIG. 4).

Due to the rotation of second reduction wheel 184, the ratchet wheel 150 rotates in a given direction, i.e. in an arrow 318 direction (clockwise in FIG. 4), thereby winding up a spiral spring 120*c* accommodated in the barrel complete 120. Due to a force of the spiral spring, the barrel complete 120 rotates in a given direction, i.e. in an arrow 320 direction (clockwise in FIG. 4) at all times.

In contrast, when the oscillating weight 160 rotates in an arrow 330 direction (counterclockwise in FIG. 4), the rotation of oscillation weight pinion 176 causes the first transmission intermediate wheel 178 in an arrow 332 direction (clockwise in FIG. 4). The rotation of first transmission intermediate wheel 178 rotates the first transmission wheel 180 in an arrow 334 direction (counterclockwise in FIG. 4).

Similarly to the above case that the oscillation weight 160 rotates in the arrow 310 direction, the pawl lever 182 causes the eccentric shaft part 180*d* to eccentrically move due to the rotation of first transmission wheel 180. Due to the eccentric motion of the pawl lever 182, the draw pawl 182*c* and the push pawl 182*d* reciprocally move along the outer periphery of the second reduction wheel 184. As a result, by the reciprocal motion of the draw pawl 182*c* and push pawl 182*d*, the second reduction wheel 184 is rotated in a given direction, i.e. in the arrow 316 direction (counterclockwise in FIG. 4).

The rotation of second reduction wheel 184 rotates the ratchet wheel 150 in a given direction, i.e. the arrow 318 direction (clockwise in FIG. 4), winding up the spiral spring 120*c* accommodated in the barrel complete 120. Due to a force of the spiral spring, the barrel complete 120 rotates in a given direction, i.e. in the arrow 320 direction (clockwise in FIG. 4) at all times.

The rotation of barrel complete 120 causes rotation in the minute wheel 122, third wheel (not shown), second wheel 124, date back wheel (not shown) and hour wheel 126. The rotation speed of barrel complete 120 is controlled by a speed regulator, such as a balance with hairspring, and an escaping device, such as a pallet fork or escape wheel & pinion (every not shown).

INDUSTRIAL APPLICABILITY

The present invention, as explained above, is a self-winding watch having a pawl lever arranged closer to the main plate than the bridge member, and has the advantages described below:

(1) it realizes a self-winding watch reduced in size and thickness;

(2) the movement on its back lid side has a good aesthetic appearance;

(3) the pawl lever has a simple structure and is easy to operate;

(4) the wheel train constituting the self-winding mechanism is positively supported for rotation.

What is claimed is:

1. A self-winding watch comprising:

a main plate having upper and lower main surfaces;

a first bridge member disposed over the upper main surface of the main plate;

a second bridge member disposed over the first bridge member;

an oscillation weight supported by the second bridge member for undergoing rotational movement;

a transmission wheel mounted for undergoing rotation in accordance with rotation of the oscillation weight, the transmission wheel having an upper guide shaft rotatably supported by the second bridge member and a lower guide shaft rotatably supported by the first bridge member;

a pawl lever disposed between the second bridge member and the upper main surface of the main plate for undergoing reciprocal movement in accordance with rotation of the transmission wheel;

a second reduction wheel for undergoing rotation in accordance with reciprocal movement of the pawl lever; and a barrel complete having a spiral spring to be wound up by rotation of the second reduction wheel.

2. A self-winding watch according to claim 1; wherein the transmission wheel is disposed between the first and second bridge members.

3. A self-winding watch according to claim 2; wherein the pawl lever is disposed between the transmission wheel and the first bridge member.

4. A self-winding watch according to claim 1; wherein the second bridge member is disposed between the transmission wheel and the first bridge member.

5. A self-winding watch according to claim 4; wherein the pawl lever is disposed between the first and second bridge members.

6. A self-winding watch according to claim 1; wherein the transmission wheel has an eccentric shaft for undergoing eccentric movement and disposed closer to the upper main surface of the main plate than the bridge member.

7. A self-winding watch according to claim 6; wherein the pawl lever is mounted on the eccentric shaft of the transmission wheel for movement therewith.

8. A self-winding watch comprising:

a main plate having upper and lower main surfaces;

a bridge member disposed over the upper main surface of the main plate;

an oscillation weight rotatably supported by the bridge member;

a transmission intermediate wheel for undergoing rotation in accordance with rotation of the oscillation weight;

a transmission wheel for undergoing rotation in accordance with rotation of the transmission intermediate wheel, the transmission wheel having an eccentric shaft part disposed closer to the upper main surface of the main plate than the bridge member;

a pawl lever mounted for undergoing eccentric movement in accordance with movement of the eccentric shaft part of the transmission wheel, the pawl lever having at least one part disposed between the upper main surface of the main plate and the bridge member;

a second reduction wheel for undergoing rotation in one direction in accordance with eccentric movement of the pawl lever;

a ratchet wheel for undergoing rotation in one direction in accordance with rotation of the second reduction wheel; and a barrel complete having a spiral spring to be wound up by rotation of the ratchet wheel.

9. A self-winding watch according to claim 8; wherein the transmission intermediate wheel has a gear having at least one part disposed between the oscillation weight and the bridge member; and wherein the transmission wheel has a gear having at least one part disposed between the oscillation weight and the bridge member.

10. A self-winding watch according to claim 8; wherein the transmission intermediate wheel has a gear having at least one part disposed between the upper main surface of the main plate and the bridge member; and wherein the transmission wheel has a gear having at least one part disposed between the upper main surface of the main plate and the bridge member.

11. A self-winding watch according to claim 8; further comprising a center wheel bridge disposed between the bridge member and the upper main surface of the main plate; and wherein the transmission wheel has an upper guide shaft rotatably supported by the bridge member and a lower guide shaft rotatably supported by the center wheel bridge.

12. A self-winding watch according to claim 11; wherein the pawl lever is disposed between the bridge member and the center wheel bridge.

13. A self-winding watch comprising:

a main plate having upper and lower main surfaces;

a first bridge member disposed over the upper main surface of the main plate;

a second bridge member disposed over the first bridge member;

an oscillation member having a pinion;

a transmission wheel having a gear, an upper guide shaft rotatably supported by the second bridge member, a lower guide shaft rotatably supported by the first bridge member, and an eccentric shaft disposed between the upper and lower guide shafts;

an intermediate transmission wheel having a gear meshing with the pinion of the oscillation member and the gear of the transmission wheel;

a pawl lever mounted on the eccentric shaft of the transmission wheel for undergoing eccentric movement; and a spiral spring member for winding up in accordance with eccentric movement of the pawl lever.

14. A self-winding watch according to claim 13; wherein the transmission wheel is disposed between the first and second bridge members.

15. A self-winding watch according to claim 14; wherein the pawl lever is disposed between the transmission wheel and the first bridge member.

16. A self-winding watch according to claim 13; wherein the second bridge member is disposed between the transmission wheel and the first bridge member.

17. A self-winding watch according to claim 16; wherein the pawl lever is disposed between the first and second bridge members.

* * * * *